United States Patent [19]

Hanson et al.

[11] Patent Number: 4,553,341

[45] Date of Patent: Nov. 19, 1985

[54] APPARATUS FOR THE HEAT TREATMENT OF LASTED SHOE UPPERS

[75] Inventors: Raymond Hanson, Rearsby; Malcolm Tillyard, Leicester, both of England

[73] Assignee: USM Corporation, Farmington, Conn.

[21] Appl. No.: 638,961

[22] Filed: Aug. 8, 1984

[30] Foreign Application Priority Data

Aug. 10, 1983 [GB] United Kingdom ..... 8321496

[51] Int. Cl.[4] ..... F26B 17/00

[52] U.S. Cl. ..... 34/236; 34/239; 12/1 A; 12/17.2; 198/803.15

[58] Field of Search ..... 34/105, 236, 239; 12/1 A, 4.1, 17.2, 142 RS, 142 T; 198/656

[56] References Cited

U.S. PATENT DOCUMENTS

| | | | |
|---|---|---|---|
| 2,512,574 | 6/1950 | Carson | 12/1 A |
| 2,751,064 | 6/1956 | Russell | 198/656 |
| 3,718,007 | 2/1973 | Randrup | 198/656 |
| 4,202,066 | 5/1980 | Hanson | 12/1 A |
| 4,369,536 | 1/1983 | Hanson et al. | 12/1 A |
| 4,423,530 | 1/1984 | White | 12/1 A |

*Primary Examiner*—Larry I. Schwartz
*Assistant Examiner*—David W. Westphal
*Attorney, Agent, or Firm*—Donald N. Halgren

[57] ABSTRACT

Apparatus for the heat treatment of lasted shoe uppers, e.g. for use in the curing of moisture-curable adhesive applied to the periphery of a shoe bottom. The apparatus comprises a treatment station (2), a conveyor belt (4) and drive means therefor, the belt being adapted to progressively present portions of lasted shoe uppers to the treatment station, and support means for the belt. The conveyor belt (4) comprises one or more rows of slots (10) extending in the direction of movement of the conveyor belt, each slot (10) being so dimensioned that a lasted shoe upper can be supported bottom up by the conveyor belt (4) with the last cone projecting into the slot. The support means preferably comprises two portions, the first portion comprising lands (16) by which the belt (4) is supported adjacent the or each row of slots (10) and a trough aligned with said path of movement, and the second portion comprising a continuous support surface (20).

17 Claims, 3 Drawing Figures

APPARATUS FOR THE HEAT TREATMENT OF LASTED SHOE UPPERS

BACKGROUND OF THE INVENTION (1) Field of the Invention

This invention is concerned with an apparatus for the heat treatment of lasted shoe uppers. The term "lasted shoe upper" where used herein is to be understood as referring to a shoe upper which has been lasted, and which is still on its last.

(2) Prior Art

Apparatus for the heat treatment of lasted shoe uppers is known, namely so-called heat setting apparatus. In this apparatus shoes on lasts are passed progressively through a tunnel and subjected to heat and moisture during such passage so that the shoe upper is caused to conform to the shape of the last and to retain such form in the finished shoe. Such an apparatus may comprise a treatment station, a conveyor belt and support and drive means for the conveyor belt. The conveyor belt and support may be provided with small apertures to facilitate the circulation of moisture and hot air through the apparatus.

In using such apparatus, generally the lasted shoe uppers are placed bottom down on the belt to be conveyed through the treatment station, that is to say, the shoe bottom rests on the surface of the belt. In other heat treatment operations, however, it may be desirable that the shoe bottom does not contact the belt, for example where adhesive in liquid form applied to the shoe bottom is to be activated or cured by the application of heat.

It is an object of this invention to provide an apparatus for use in the heat treatment of lasted shoe uppers wherein lasted shoe uppers, bottoms of which are coated with a liquid composition, may be progressively presented to a treatment station without bringing the coating into contact with any part of the apparatus.

BRIEF SUMMARY OF THE INVENTION

The invention thus provides an apparatus for the heat treatment of lasted shoe uppers comprising a treatment station, a conveyor belt and drive means therefor, said belt being adapted to progressively present portions of lasted shoe uppers to the treatment station, and support means for the belt, wherein the conveyor belt contains a row of slots extending in the direction of movement of the conveyor belt, each slot being so dimensioned that a lasted shoe upper can be supported bottom up by the conveyor belt with the last cone projecting into the slot, and further wherein the support means is such that the belt is supported adjacent the path of movement of the slots while remaining unsupported beneath said path of movement.

In general the slots of the conveyor belt may be cut to an optimum size which will allow different sizes of lasted shoe uppers to be supported by the belt, for example in both men's and women's size ranges. However, in order to accommodate a much smaller last, e.g. in a children's range, or a last so shaped that it would have a tendency to fall through a slot so dimensioned, the slots of the conveyor belt may be of different dimensions, the dimensions of the slot corresponding to the size of the last desired to be inserted therein.

The belt is provided with support means which is preferably made from a rigid sheet material for example sheet metal. The support means comprises lands by which the belt is supported adjacent the path of movement of the slots and a trough aligned with said path of movement which allows the slots to be unsupported beneath their path of movement. The trough is of a depth sufficient to allow unhindered passage of the lasted shoe upper through the apparatus and thus must be of depth greater than the height of the last cone. The width of the trough must be greater than the width of a slot into which the lasted shoe upper is inserted. In an alternative embodiment the support means may comprise a system of pulley wheels so arranged that the wheels are positioned adjacent the path of movement of the slots, for example, arranged in a line along the sides of said path of movement. In order to provide sufficient support for the belt the pulley wheels should be of a width corresponding to the distance between the rows of slots and should be of sufficient size to provide a trough aligned with the path of movement of the row of slots as hereinabove described.

The conveyor belt may comprise two portions, a first portion containing the row of slots and a second portion comprising a support surface free of slots. This arrangement allows a shoe bottom and a shoe sole, e.g. to each of which adhesive has been applied, to be passed simultaneously through the apparatus to effect cure of the adhesive prior to their being bonded together.

In a preferred embodiment the conveyor belt comprises a plurality of rows of slots so that an increased number of lasted shoe uppers may be presented to the treatment station at any one time; where the first portion comprises a plurality of rows of slots, the belt may also conveniently comprise a second portion remaining free for the support of shoe soles.

It is envisaged that at any one time the apparatus in accordance with the invention will be used for the heat treatment of lasted shoe uppers in one size range only. However, it may be considered desirable that the apparatus has the facility to accommodate more than one size range. This may be achieved by an arrangement wherein the belt comprises a first row of slots and a second row of slots, the slots of the first row being of the same dimensions but being differently dimensioned from those of the second row and wherein the support means comprises a first support means arranged to support the belt adjacent the slots of one of the first or second rows and a second support means comprising a continuous support surface for supporting the belt in the region of the other of said rows, the conveyor belt being arranged to be reversible so that a selected one of the first or second rows is aligned with the first support means. In such arrangement, reversibility of the belt is achieved by means of a metallic loop fastener clinched into each end of the fabric comprising the belt, each fastener comprising a series of loops, and the two ends being joined by overlapping the loops and inserting a metal pin therethrough. When it is desired to insert lasted shoe uppers into said other of said first or second rows, the belt may simply be reversed by withdrawing the pin which thus unfastens the belt, turning the belt over and refastening it by the insertion of the pin, with said other of said rows aligned with the first support means.

In another embodiment of the invention, the first portion of the conveyor belt comprises a plurality of rows of slots and the second portion of the belt comprises an equal number of rows and the support means comprises a first support means arranged to support the belt adjacent the slots of the rows of the first or second portion and a second support means comprising a continuous support surface for supporting the belt in the region of the other of said portions and further wherein the conveyor belt is reversible so as to enable rows of a selected one of the first or second portions to be aligned with the first support means. Preferably the slots of the first portion are of the same dimension but are differently dimensioned from those of the second portion. By this arrangement a sole corresponding to each of the lasted shoe uppers inserted into a slot of the belt may be placed on the second portion of the belt (being too large to fall through the slots in the belt). When it is desired to use lasted shoe uppers of the size corresponding to the slots provided in the second portion of the belt, the belt may simply be reversed as described above, the lasted shoe uppers inserted into the appropriate slots and the soles placed on the portion of the belt supported by the continuous support surface of the support means.

Preferably where the belt comprises a plurality of rows of slots the belt is supported by the support means between adjacent rows so that the path of movement of each row of slots is aligned with a separate trough of the support means and the belt between the rows is supported whereby to give maximum support to lasted shoe uppers. The slots of adjacent rows may be staggered in relation to one another in order to maximize the support given by the belt.

Preferably apparatus according to the invention also comprises means by which after heat treatment the lasted shoe uppers are removed from the slots as they are conveyed from the treatment station. For example, the lasted shoe uppers may be removed directly from the belt by an operator or shoe and sole support rails may be provided onto which the lasted shoe uppers and soles ride after passing through the treatment station.

The drive means of a preferred apparatus in accordance with the invention comprises a motor-driven wheel which extends substantially across the width of the belt. The drive wheel conveniently comprises for the or each row of slots a groove extending lengthwise of the or each trough. The depth of the groove is greater than the distance by which the last cone projects below the level of the belt. The conveyor belt may thus convey lasted shoe uppers along the troughs of the support means, through the grooves of the drive wheel and onto shoe and sole support rail means. The drive means is suitably driven by a variable speed motor which preferably operates to advance the conveyor belt continuously through the treatment station.

Cam plates extending from the troughs may be provided which are arranged to bear on the last cone and thus cause the last to be forced up and out of the slots and on to the shoe and sole support rails.

The apparatus according to the invention may be for use in the drying of latex. However, it is envisaged that the apparatus will find use in the curing of moisture-curable adhesive applied to the periphery of a shoe bottom; one such adhesive, which comprises a urethane prepolymer composition provided as a fluid composition which is convertible, by a chain extension treatment (by curing) to a polyurethane, which, when heated, is tacky and capable of establishing a substantially strong adhesive union with a compatible adhesive or resin surface, is identified as Bostik RSF 21 ('Bostik' is a registered Trade Mark). The curing of this composition preferably takes place by the application of heat and moisture, and to this end the treatment station of the apparatus according to the invention conveniently comprises a steam compartment provided with means for supplying steam to said compartment and a heat compartment provided with means for supplying heat to said heat compartment. The means for supplying steam to the steam compartment may comprise a hose connected to an electric boiler and water is boiled in the boiler and steam passes to the compartment along the hose. The means for supplying heat to the heat compartment may comprise calrod heaters over which air is passed before entry into the heat compartment.

Preferably, furthermore, in such apparatus, a curtain is provided at the entrance to and at the exit of the treatment station so as to minimize the escape of heat and moisture from the treatment station. The curtain may comprise a fabric curtain which may comprise a series of fabric strips, or an air curtain. The air curtain is produced by blowing air downwards in front of both apertures using a centrifugal fan which thus creates an air barrier and so prevents moisture and heat from percolating therethrough.

In addition, the steam compartment and heat compartment may be separated by a curtain. Alternatively, however, desired environmental conditions may be provided in a single chamber. In such a chamber the means for supplying steam supplies steam to a steam inlet which is located at an entrance region of the chamber and the means for supplying heat supplies heat to a heat inlet which is located at an exit region of the chamber. Preferably in both cases the temperature in the chamber is in the range 80° C. to 120° C. more preferably 90° C. to 110° C. The dew point of the chamber at the steam inlet is in the range 45° C. to 65° C., suitably about 60° C. Desirably the lasted shoe uppers are subjected to moisture and heat gradients in the chamber and pass from a higher moisture/lower temperature environment to a lower moisture/higher temperature environment; for example, the temperature in the former environment may be about 95° C. and in the latter environment 105° C., and the dew points may be about 60° C. and 50° C. respectively.

The conveyor belt may be caused to present the lasted shoe uppers to the treatment station at the rate desired for the heat treatment. Suitably the lasted shoe uppers to be treated in an apparatus according to this invention are subjected to heat and moisture treatment over a period of 30 seconds to 3 minutes, more preferably $1\frac{1}{2}$–$2\frac{1}{2}$ minutes. It is envisaged, however, that this period may be reduced.

BRIEF DESCRIPTION OF THE DRAWINGS

There now follows a detailed description to be read with reference to the accompanying drawings, of an apparatus according to the invention, hereinafter called 'the illustrative apparatus'. It will of course be appreciated that this illustrative apparatus has been selected for description merely by way of exemplification of the invention and not by way of limitation thereof.

In the accompanying drawings

DESCRIPTION OF THE PREFERRED EMBODIMENTS

The illustrative apparatus is for use in curing moisture-curable polyurethane adhesive supplied from Bostik Limited under the trade mark "RSF 21" which has been applied to the bottoms of lasted shoe uppers and to shoe soles which it is desired to bond together.

Figure 1:
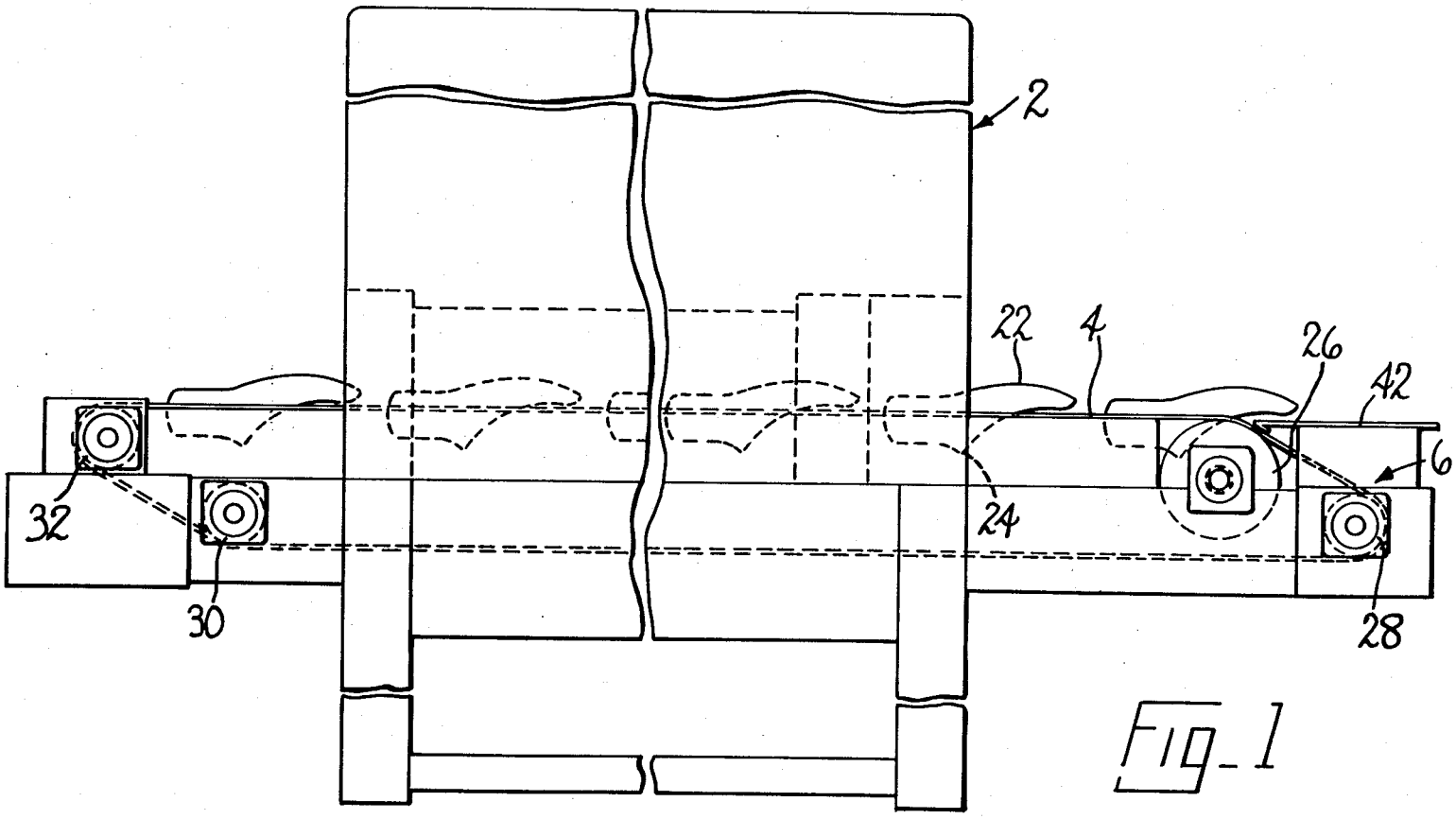
FIG. 1 is a side elevational view of the illustrative apparatus.
Figure 2:
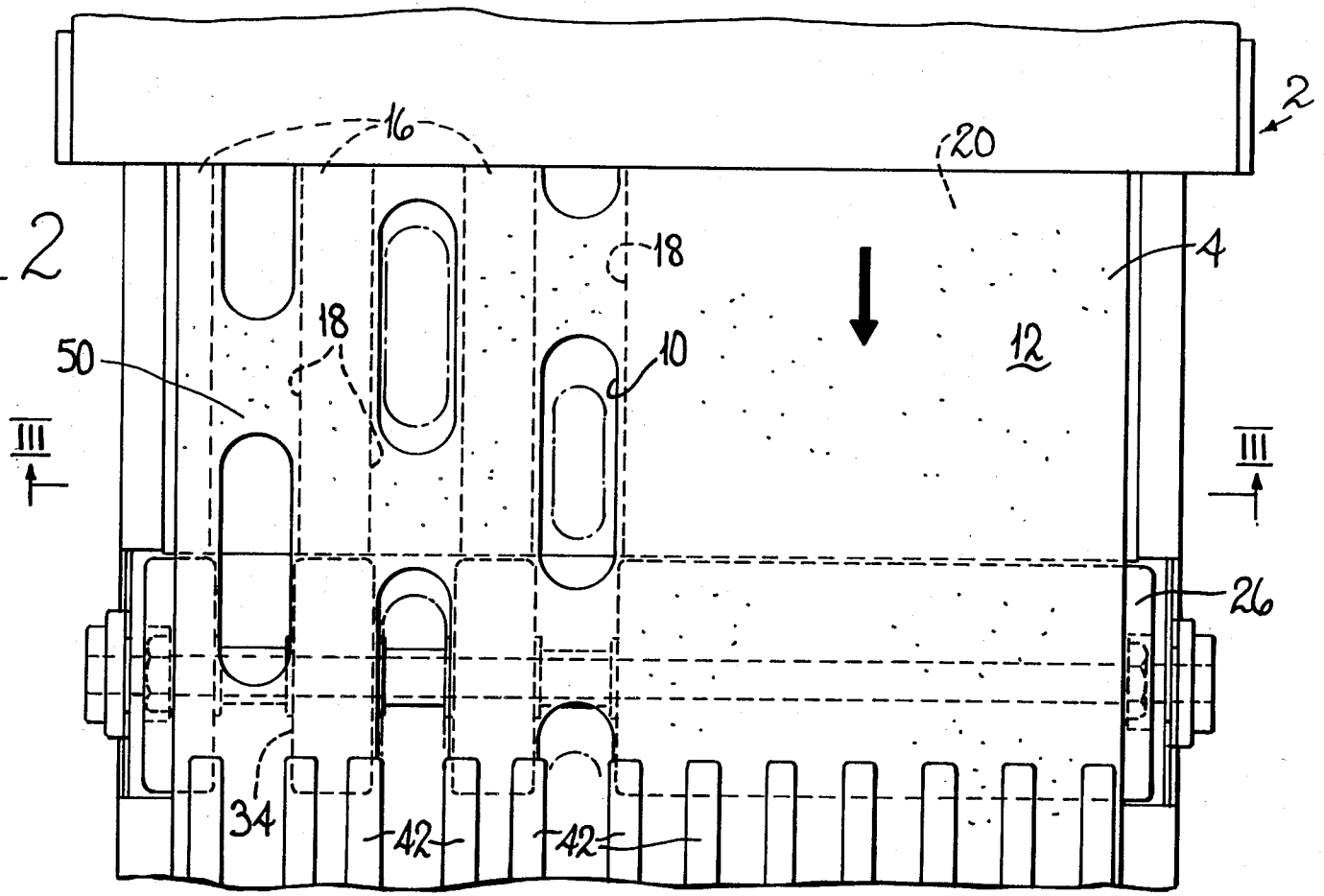
FIG. 2 is a plan view of the illustrative apparatus.

The illustrative apparatus comprises a treatment station generally designated 2, a conveyor belt 4, drive means generally designated 6 and support means generally designated 8. The conveyor belt 4 which is shown more clearly in FIG. 2, is made of woven white terylene (available from Scandura) and comprises first and second portions. The first portion is provided with three parallel rows of slots 10, each row extending in the direction of movement of the conveyor belt 4. The slots 10 are so dimensioned that a lasted shoe upper inserted therein is supported bottom up by the conveyor belt 4. The slots shown in full line in FIG. 2 are an optimum size for receiving men's and women's lasted shoe uppers, said slots being dimensioned 53 mm × 190 mm and pitched at 330 mm intervals along the length of the belt. Two other sizes of slots 10 are shown in chain-dot line in FIG. 2, suitable for receiving women's and children's lasted shoe uppers. The second portion of the belt 4 comprises an unslotted support surface 12.

Figure 3:
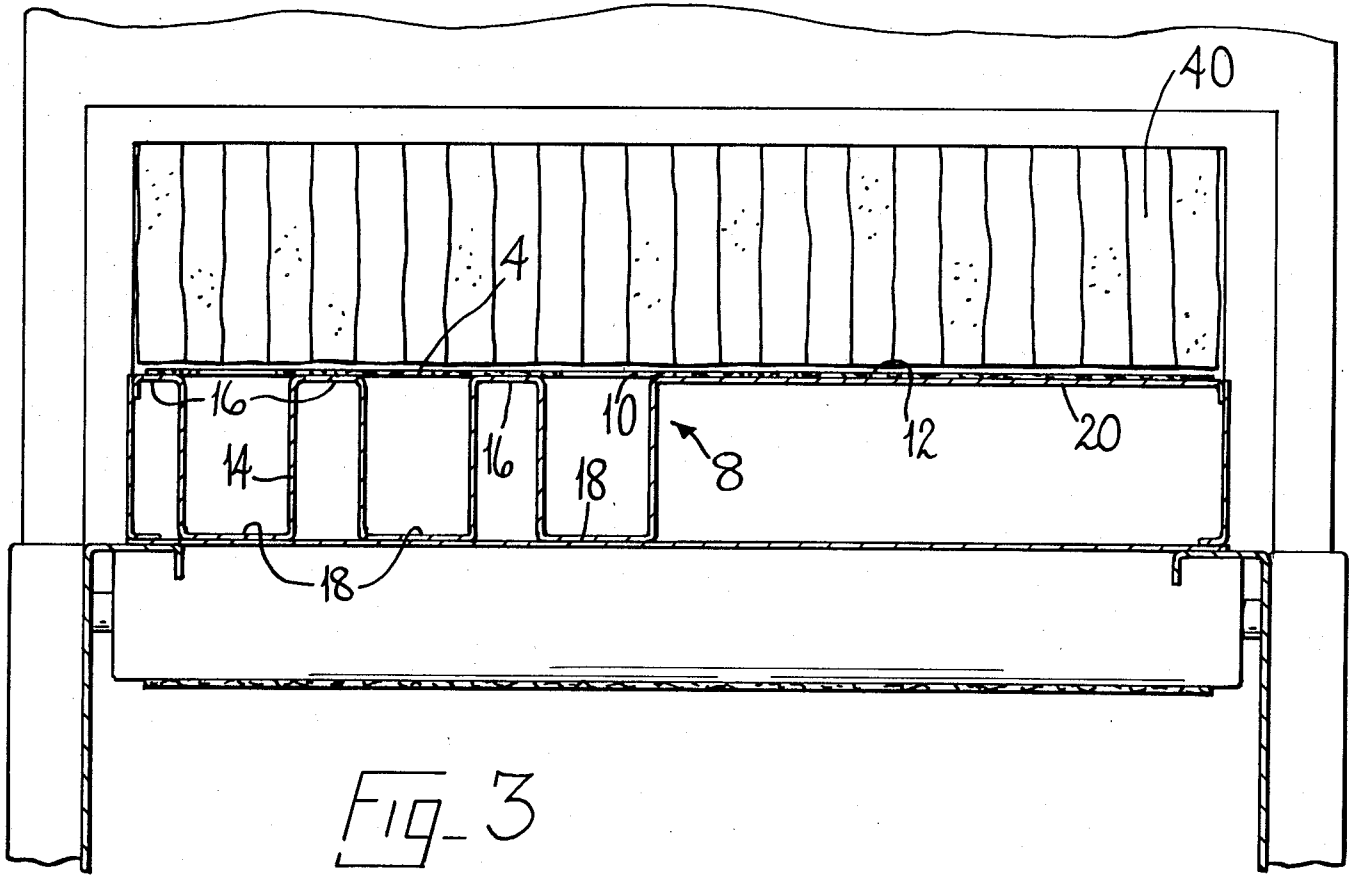
FIG. 3 is a sectional view take on the line III-III of FIG. 2.

The support means 8 is shown more clearly in FIG. 3. The support means 8 comprises a metal sheet 14 comprising first and second portions. The first portion comprises lands 16 which are adapted to support the belt 4 between the rows of slots 10, and parallel troughs 18 which allow unhindered passage of the lasted shoe uppers along their path of movement through the apparatus. The troughs 18 are sufficiently wide to accommodate the width of a lasted shoe upper and must be of a depth greater than the distance to which a last cone 24 inserted into a slot 10 protrudes below the level of the belt 4. Suitably the dimensions of the trough are 60 mm in width and 70 mm in depth. The second portion of the support means 8 comprises a continuous support surface 20 which supports the support surface 12 of the belt 4. The support surface 12 may be used for supporting shoe soles (not shown).

The drive means 6 comprises a motor-driven drive wheel 26 and guide wheels 28,30,32. The drive wheel is provided with grooves 34, the grooves extending from the troughs 18 of the support means 8, so that the path of movement of the rows of slots of the belt is aligned with the troughs 18 of the support means, the grooves 34 of the drive wheel and a rail support 42.

The treatment station 2 comprises a single chamber provided with a steam inlet (not shown) and a heat inlet (not shown).

In the operation of the illustrative apparatus the temperature and dew point at the entrance to the chamber were measured as 95° C. and 60° C. respectively and 105° C. and 45° C. respectively at the exit of said chamber.

A fabric curtain 40 is provided at the entrance to and the exit of the treatment station of the illustrative apparatus.

In operation, the conveyor belt is driven by a variable speed motor (not shown) driving the drive wheel 26, and thus the belt 4, continuously at a desired speed.

Lasted shoe uppers 22 to which the moisture-curable adhesive has been applied are inserted bottom up into the slots 10 of the belt 4 by an operator, the last cone projecting below the level of the belt. A sole corresponding to each lasted shoe upper 22 is placed on the support surface 12 of the belt. The belt 4 progresses continuously through the apparatus, the path of movement of the rows of slots containing the lasted shoe uppers passing over the trough 18 provided by the stationary support means 8. The belt 4 is driven at a rate to allow the lasted shoe uppers to be subjected to heat treatment over a period of, for example, two and a half minutes; as discussed above the treatment period can be adjusted, as desired, by adjusting the speed of the motor. After passage through the apparatus the belt containing the lasted shoe uppers passes from the support means over the drive wheel 26. The last cones projecting below the level of the conveyor belt thus pass from the troughs 18 of the support means and through the grooves 34 provided in the drive wheel. At the end of the upper reach of the belt, the lasted shoe uppers are caused to ride up on the rail support 42 and thus are removed from the apparatus.

In another apparatus according to the invention, otherwise similar to the illustrative apparatus, the belt is arranged to be reversible or adjustable so that shoes of two different sizes may be accommodated by the belt to be progressively presented to the treatment station 2 at different times. In this apparatus a first portion of the belt is provided with three rows of slots 10 of a first size and a second portion, instead of providing an unslotted support surface, is provided with three rows of slots of a second size. The support means 8 of the belt comprises a first support means comprising three lands 16 arranged to support the belt adjacent the rows of slots, and three troughs 18 and a second support means comprising a continuous support surface 20. Lasted shoe uppers of a size corresponding to the rows of slots of the first size are subjected to heat treatment as hereinabove described. When it is desired to subject lasted shoe uppers of a size corresponding to the rows of slots of the second size to the heat treatment, the following procedure is carried out. The drive to the conveyor belt is stopped when all the lasted shoe uppers have been removed from the belt. Ends of the belt, which are joined by means of a metal pin engaging a metallic loop fastener, are unfastened by withdrawing the metal pin from the metallic loop fastener. The belt is then reversed and the ends of the belt are then re-fastened, with the rows of slots of the second size aligned with the troughs of the first support means. The apparatus may then be put into operation as hereinabove described.

We claim:

1. Apparatus for treating lasted shoe uppers, comprising a treatment station, a movable conveyor belt and drive means therefor, said belt being adapted to progressively present portions of lasted shoe uppers to the treatment station, and support means for the belt, wherein the conveyor belt contains a row of slots having a long dimension which extends in the direction of movement of said conveyor belt, each slot being so dimensioned that a lasted shoe upper can be supported bottom up by the conveyor belt with its last cone projecting into the slot, and further wherein the support means is such that the belt is supported adjacent the path of movement of the slots by physical engagement while remaining physically unsupported beneath said path of movement of the slots.

2. Apparatus according to claim 1 wherein the slots are of different dimensions.

3. Apparatus according to claim 2 wherein the support means is made from rigid sheet material and comprises lands by which the belt is supported adjacent the path of movement of the slots as aforesaid and a trough aligned with said path of movement.

4. Apparatus according to claim 2 wherein the support means comprises a system of pulley wheels so arranged that the wheels are positioned adjacent the path of movement of the slots as aforesaid.

5. Apparatus according to any one of claims 1 to 4 wherein the conveyor belt comprises two portions, a first portion containing a row of slots and a second portion comprising a support surface free of slots for supporting shoe soles.

6. Apparatus according to claim 5 wherein the first portion of the conveyor belt comprises a plurality of rows of slots.

7. Apparatus according to claim 6 wherein the belt is supported between adjacent rows.

8. Apparatus according to claim 6 wherein the slots of adjacent rows are staggered in relation to one another.

9. Apparatus according to any one of claims 1 to 4 wherein the conveyor belt comprises a plurality of rows of slots.

10. Apparatus according to claim 1 wherein the belt comprises a first row of slots and a second row of slots, each of the slots of the first row being of the same dimensions but being differently dimensioned from each of the slots of the second row and wherein the support means comprises a first support means arranged to support the belt adjacent the slots of one of the first or second rows and a second support means comprising a continuous support surface for supporting the belt adjacent the other of said rows and further wherein the conveyor belt is adjustable so as to enable a selected one of the first or second rows to be aligned with the first support means.

11. Apparatus according to claim 1 wherein the conveyor belt has a first portion which comprises a plurality of rows of slots, and a second portion of the belt which comprises an equal number of rows of slots, wherein the support means comprises a first support means arranged to support the belt adjacent the slots of the rows of the first or second portion and a second support means comprising a continuous support surface for supporting the belt in a region of the other of said portions and further wherein the conveyor belt is adjustable so as to enable rows of a selected one of the first or second portions to be aligned with the first support means.

12. Apparatus according to claim 1 comprising a means by which the lasted shoe uppers are removed from the slots as they are conveyed from the treatment station after they have received a heat treatment.

13. Apparatus according to claim 12 wherein the drive means operates to advance the conveyor belt continuously through the treatment station.

14. Apparatus according to claim 13 wherein the drive means comprises a drive wheel which extends substantially across the width of the belt and which comprises, for the or each row of slots, a groove the depth of which is greater than the distance by which the last cone projects below the level of the belt.

15. Apparatus according to claim 14 wherein the treatment station comprises a steam compartment provided with means for supplying steam to said steam compartment and a heat compartment provided with means for supplying heat to said heat compartment.

16. Apparatus according to claim 15 wherein the steam compartment and heat compartment are separated by a curtain.

17. Apparatus according to either one of claims 14 and 15 wherein the chamber is heated to a temperature in the range of 90° C. to 110° C., the dew point of the chamber is in the range 45° C. to 65° C. and the lasted shoe uppers are subjected to heat treatment over a period of $1\frac{1}{2}$ to $2\frac{1}{2}$ minutes.

* * * * *